US005483899A

United States Patent [19]

Christie

[11] Patent Number: 5,483,899

[45] Date of Patent: Jan. 16, 1996

[54] MODULAR PALLET ARRANGEMENT

[76] Inventor: Eugene P. Christie, 555 Edgemount La., Park Ridge, Ill. 60068

[21] Appl. No.: 270,579

[22] Filed: Jul. 5, 1994

[51] Int. Cl.[6] ..... B65D 19/00

[52] U.S. Cl. ..... 108/56.3; 108/901

[58] Field of Search ..... 108/51.1, 51.3, 108/52.1, 56.1, 56.3, 901; 206/389, 600, 599, 597, 598

[56] References Cited

U.S. PATENT DOCUMENTS

| | | | |
|---|---|---|---|
| 3,307,504 | 3/1967 | Cloyd et al. . | |
| 3,650,224 | 3/1972 | Petix et al. | 108/51.1 |
| 3,651,769 | 3/1972 | Floyd . | |
| 3,664,271 | 5/1972 | Wolder et al. . | |
| 3,857,342 | 12/1974 | Johns . | |
| 4,013,021 | 3/1974 | Steinlein et al. | 108/51.1 |
| 4,597,338 | 7/1986 | Kreeger . | |
| 4,694,962 | 9/1987 | Taub . | |
| 4,735,154 | 4/1988 | Hemery | 108/51.1 |
| 4,799,433 | 1/1989 | Luft | 108/51.1 |
| 4,843,979 | 7/1989 | Pigott et al. . | |
| 5,094,175 | 3/1992 | Christie . | |

FOREIGN PATENT DOCUMENTS

| | | | |
|---|---|---|---|
| 1156430 | 6/1969 | United Kingdom | 108/51.1 |

*Primary Examiner*—Kenneth J. Dorner
*Assistant Examiner*—Gerald A. Anderson
*Attorney, Agent, or Firm*—Richard W. Carpenter

[57] ABSTRACT

A modular pallet arrangement that includes an upper pallet section, with a plurality of grid-like upper units having downwardly facing, cup-like, upper connector elements, and a lower section, with a plurality of grid-like lower units having upwardly facing, cup-like lower connector elements adapted for telescoping engagement with connector elements of the upper units to provide interlocking relationship between, and support for, the upper pallet section units, and including a plurality of elongated, rigid, reinforcing members interconnecting portions of the lower section units.

20 Claims, 3 Drawing Sheets

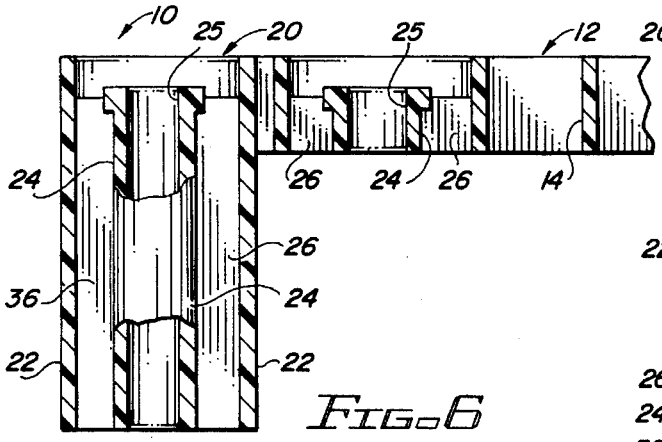
FIG. 6
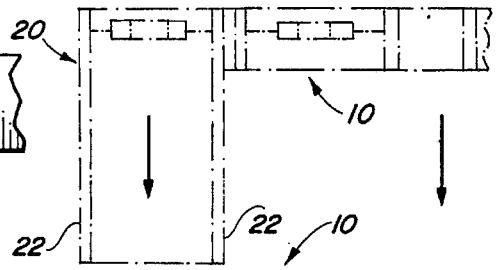
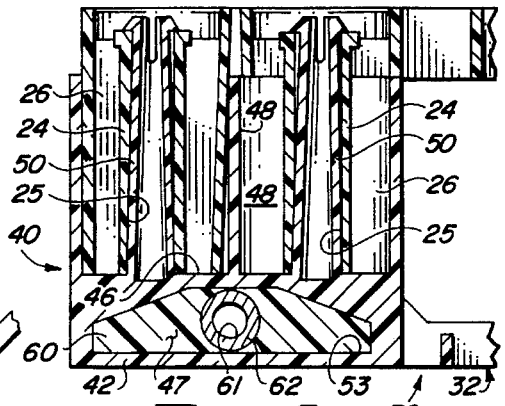
FIG. 8
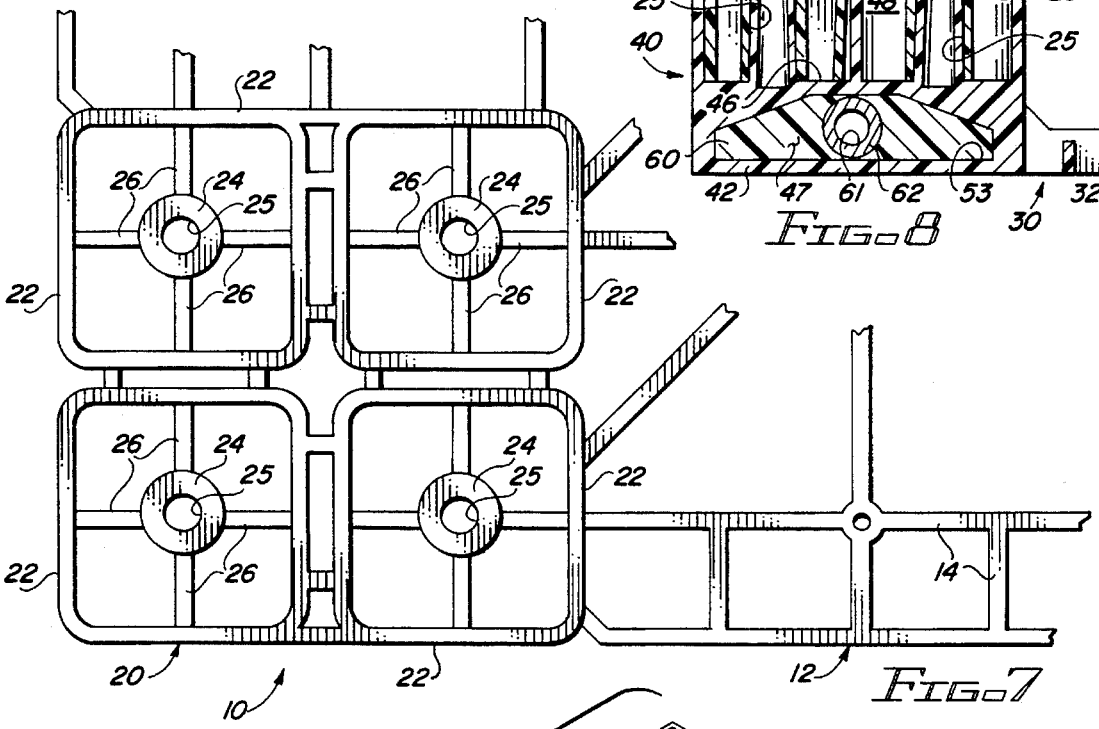
FIG. 7
FIG. 9
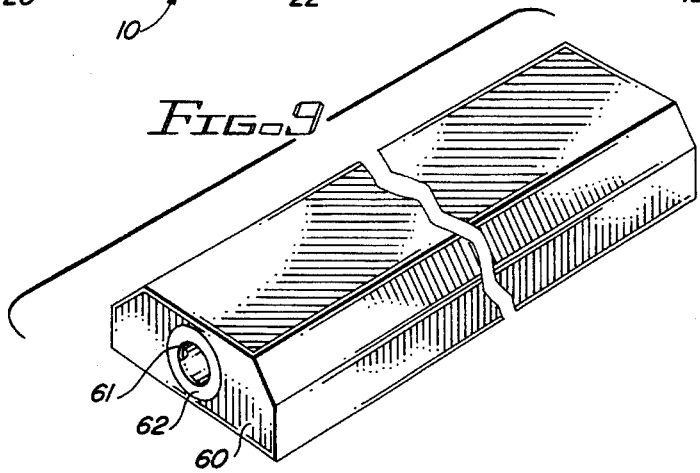

MODULAR PALLET ARRANGEMENT

BACKGROUND OF THE INVENTION

1. Field of the Invention

This invention relates to pallets used in the transportation and warehousing of industrial and commercial products, and more particularly to an improved modular pallet comprising separate, molded plastic, upper and lower pallet units, formed from recycled and recyclable plastic material, and adapted to be joined to each other in an interlocking relationship.

2. Description of the Background Art

A background art search directed to the subject matter of this invention conducted in the United States Patent and Trademark Office disclosed the following United States Letters Patent:

| | | | |
|---|---|---|---|
| 3,307,504 | 3,650,224 | 3,651,769 | 3,664,271 |
| 3,857,342 | 4,189,125 | 4,597,338 | 4,694,962 |
| 4,843,976 | 5,094,175 | French Patent | 2,362,053 |
| and German Patents | | 2,106,234 | 2,231,178 |

None of the patents uncovered in the search discloses a modular pallet arrangement comprising an upper pallet section, including a plurality of grid-like upper units having downwardly facing upper connector elements, and a lower section comprising a plurality of laterally reinforced, grid-like, lower units having upwardly facing lower connector elements adapted for telescoping engagement with connector elements of upper units to provide interlocking relationship between and support for the upper pallet section units.

SUMMARY OF THE INVENTION

This invention is an improvement over the invention disclosed and claimed in my U.S. Pat. No. 5,094,175, dated Mar. 10, 1992.

It is a primary object of the invention to provide a modular pallet that includes separate upper and lower sections having interlocking engagement with each other.

Another object of the invention is the provision of a modular pallet arrangement wherein all of the pallet sections are formed of recycled molded plastic material that is also recyclable.

Yet another object of the invention is to provide a modular pallet wherein the pallet is capable, when heavily loaded and stacked with similar loaded pallets, of being supported at its side edges by laterally spaced warehouse rack rails.

A more specific object is the provision of a modular pallet arrangement comprising an upper pallet section, including a plurality of grid-like upper units having downwardly facing upper connector elements, and a lower section comprising a plurality of laterally reinforced, grid-like, lower units having upwardly facing lower connector elements adapted for telescoping engagement with connector elements of upper units to provide interlocking relationship between and support for the upper pallet section units and being interconnected by elongated, rigid, reinforcing members.

These and other objects of the invention will be apparent from an examination of the following description and drawings.

BRIEF DESCRIPTION OF THE DRAWINGS

FIG. 6 is a vertical sectional view taken on line 6—6 of FIG. 1;

FIG. 7 is a to plan view of the structure illustrated in FIG. 1;

FIG. 8 is a vertical sectional view of a portion of the structure illustrated in FIG. 1, illustrating the telescoping engagement between related upper and lower pallet section connecting members; and FIG. 9 is an isometric view, reduced in scale, of a reinforcing bar illustrated in the other views.

Figure 1:
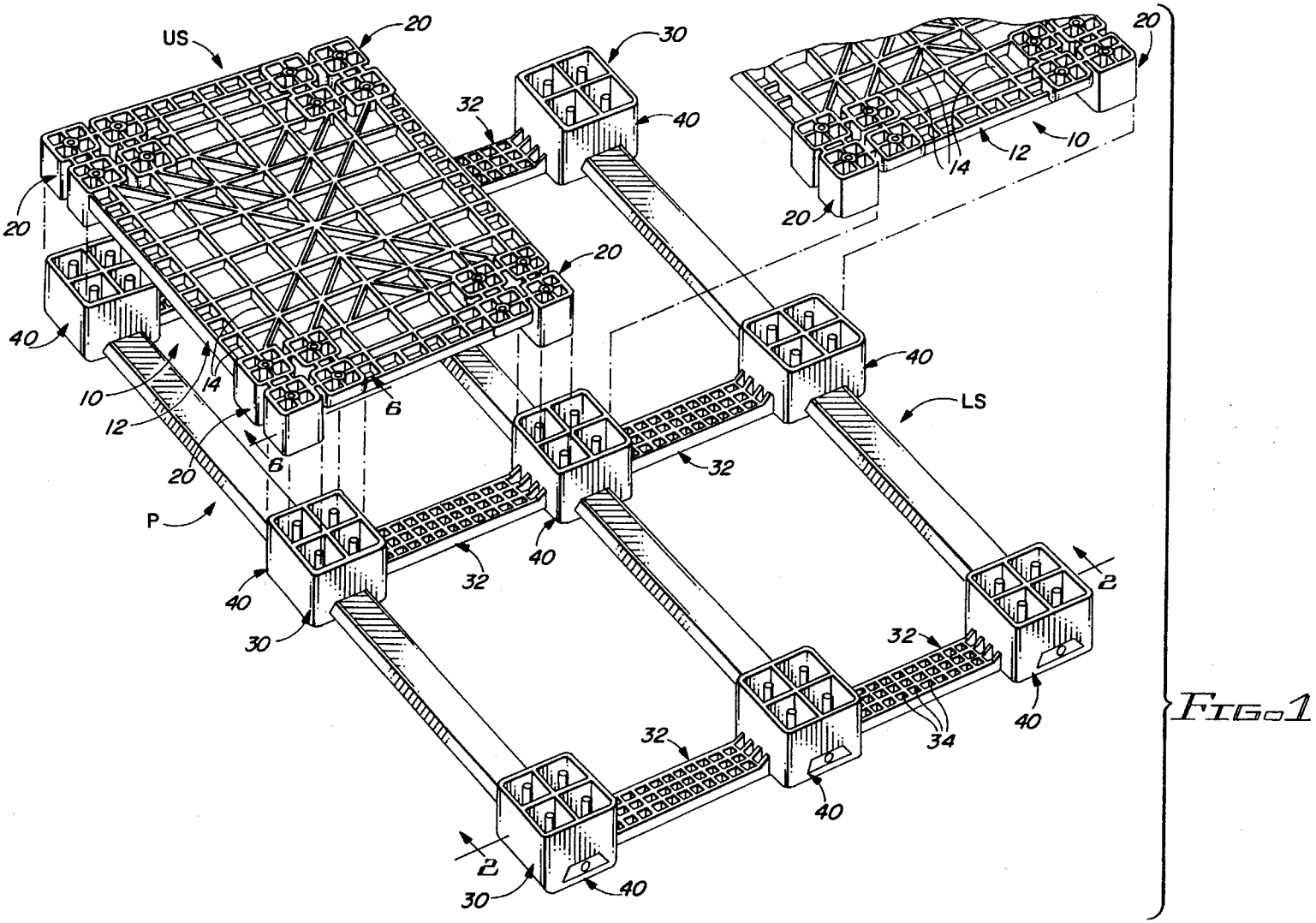
FIG. 1 is an exploded view of a modular pallet arrangement embodying features of the present invention, with portions of the structure removed to the letter illustrate the invention.
Figures 2, 3, 4, 5:
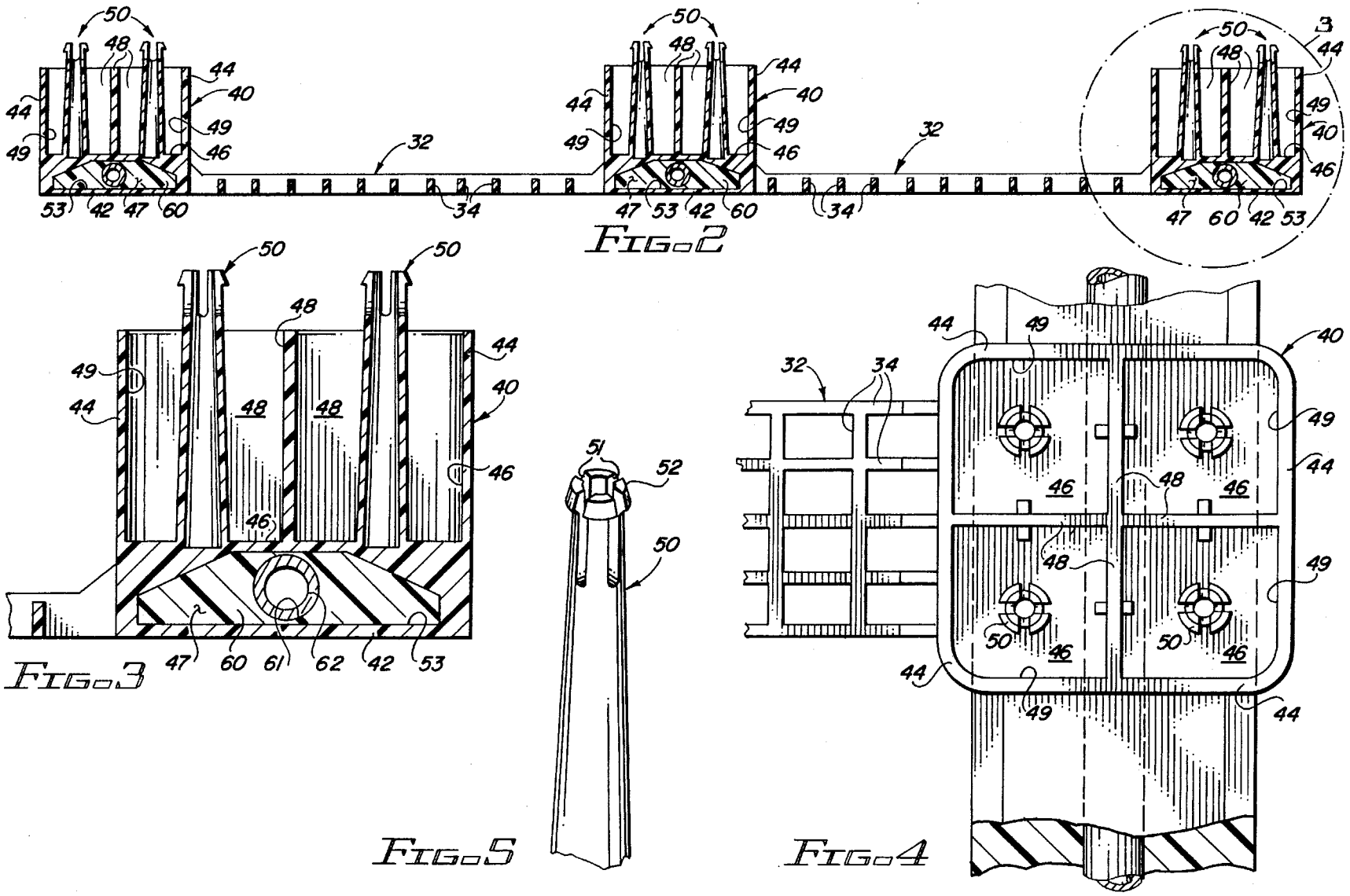
FIG. 2 is a vertical sectional view taken on line 2—2 of FIG. 1.
FIG. 3 is an enlarged view of a portion of the structure illustrated in FIG. 2.
FIG. 4 is a to plan view of the structure illustrated in FIG. 3.
FIG. 5 is an isometric view of one of the posts of the bottom station connector members illustrated in the other views.

It will be understood that, for purposes of clarity, certain elements may have been omitted from certain views where they are believed to be illustrated to better advantage in other views.

DESCRIPTION OF THE PREFERRED EMBODIMENT

Referring now to the drawings for a better understanding of the invention, it will be seen that the invention is a modular pallet arrangement wherein a pallet indicated at P includes an upper section, indicated generally at US, comprising plurality of similar, rectangular, upper units 10, which are connected to each other and supported by a lower section, indicated generally at LS, comprising plurality of elongated, rectangular, lower units 30.

The upper section units 10 each includes a grid-like base member 12, formed by a plurality of integral, vertical plates or struts 14, and having, at each corner thereof, four separate, integral, downwardly extending, cup-like, upper connector elements 20 that are arranged in back-to-back relationship and adapted for interlocking engagement with related lower section connector elements in a manner hereinafter described.

Each upper connector element 20 includes pairs of opposed side walls 22 which define a cup-like structure open at the top and bottom and having in the center thereof a hollow vertical tube 24, having a central opening or bore 25, and which is supported from the side walls 22 by a plurality of vertically extending walls 26.

The lower section lower units 32 each include a grid-like base member 34, formed by a plurality of integral, vertical plates or struts 36, and having, an each ,end thereof and intermediate the ends thereof, integral, upwardly extending, quadruple compartmented, cup-like, end and center lower connector elements 40, respectively.

Each lower connector element 40 includes a bottom wall 42 having pairs of opposed side walls 44 extending upwardly therefrom to define therewith a cup-like structure. Spaced above bottom wall 42 and extending laterally between side walls 44 is an upper wall or floor 46 that defines with bottom wall 42 and the lower portions of side walls 44 a lower space or compartment 47.

The upper section of each lower connector element 40 includes a pair of integral, intersecting, vertical, interior walls that divide the upper portion of the lower connector element into four separate compartments 49, each of which is larger than and capable of receiving a separate upper connector element 20.

Positioned within each compartment 49 and extending upwardly from floor 46 is a lightly tapered post 50 adapted to be telescopically received within a related upper connector element tube 24. The upper end of each post 50 may be provided with a downwardly extending slot 51, to facilitate insertion of the post within the related tube, and an enlarged head 52, to lock the post in place after it has been inserted into the tube.

An essential feature of the invention is the reinforcing arrangement wherein a rigid bar 60 is positioned to extend through complementary receiving openings 53 in the lower portions of the side walls 44 of the connector elements 40 of each lower section unit.

As best seen n FIG. 1, each bar 60 extends completely through the connector elements of the lower units in the space 47 between the connector element floor 46 an lower wall 42.

In the embodiment of the invention illustrated in the drawings, the reinforcing member 60 is shown as a rectilinear bar, preferably having six sides, and which may be formed of either plastic or metal. The bar 60 may also include a cylindrical opening or bore 61 extending axially therethrough which is adapted to receive a cylindrical plastic or metal bar or tube 70 to provide additional strength.

In certain instances, depending on the amount of weight intended to be carried by each pallet, the size and shape of the reinforcing member can be varied. The reinforcing member may be formed of either metal or plastic, may be rectilinear or cylindrical, and may include a plastic or metal inner reinforcing tube, as required.

It will be understood that in the arrangement of each embodiment described ad illustrated herein, the use of reinforcing members serves to make the complete pallet sufficiently rigid, so that lighter weight and less expensive plastic material can be used to form the pallet sections.

What is claimed is:

1. A modular pallet arrangement formed of a plurality of molded plastic units adapted to be interconnected in interlocking relation to form one complete pallet that, when heavily loaded and stacked with similar pallets, is capable of being supported only by laterally spaced warehouse rack rails, comprising:

(a) an upper section including a plurality of generally similar upper units, each comprising a rectangular, grid-like, base member having, at each corner thereof, four separate, integral, downwardly extending, upper connector elements;

(b) a lower section including a plurality of elongated lower units each comprising a flat, rectangular, grid-like base member having, at each end thereof and intermediate the ends thereof, quadruple compartmented, integral, upwardly extending, end and center connector elements, respectively;

(c) certain compartments of certain of said lower unit connector elements being arranged and disposed for telescoping relation with corresponding upper connector elements of at least two adjacent, but separate, upper units to connect said adjacent upper units to each other, whereby said upper pallet section is supported on and by said lower pallet section;

(d) said lower section including elongated, rigid, reinforcing members extending laterally between corresponding connector elements of lower units to prevent said pallet from sagging in the center.

2. A modular pallet arrangement according to claim 1, wherein each of said reinforcing members is a solid bar.

3. A modular pallet arrangement according to claim 1, wherein each of said reinforcing members is a bar having a cylindrical opening extending lengthwise therethrough.

4. A modular pallet arrangement according to claim 1, wherein each of said reinforcing members is an elongated plastic bar having cylindrical opening extending lengthwise therethrough and having a cylindrical metal tube positioned within said opening.

5. A modular pallet arrangement according to claim 1, wherein each of said reinforcing members is a rectilinear plastic bar.

6. A modular pallet arrangement according to claim 1, wherein each of said reinforcing members is a cylindrical metal tube.

7. A modular pallet arrangement formed of a plurality of molded plastic units adapted to be interconnected in interlocking relation to form one complete pallet that, when heavily loaded and stacked with similar pallets, is capable of being supported only by laterally spaced warehouse rack rails, comprising:

(a) an upper section including a plurality of generally similar upper units, each comprising a rectangular, grid-like, base member having, at each corner thereof, separate, integral, downwardly extending, upper connector elements;

(b) a lower section including a plurality of elongated lower units each comprising a flat, rectangular, grid-like base member having, at each end hereof and intermediate the ends thereof, multiple compartmented, integral, upwardly extending, end and center connector elements, respectively;

(c) certain compartments of certain of said lower unit connector elements being arranged and disposed for telescoping relation with corresponding upper connector elements of at least two adjacent, but separate, upper units to connect said adjacent upper units to each other, whereby said upper pallet section is supported on and by said lower pallet section;

(d) said lower section including elongated, rigid, reinforcing members extending laterally between corresponding connector elements of lower units to prevent said pallet from sagging in the center.

8. A modular pallet arrangement according to claim 7, wherein each of said reinforcing members is a solid bar.

9. A modular pallet arrangement according to claim 7, wherein each of said reinforcing members is a bar having a cylindrical opening extending lengthwise therethrough.

10. A modular pallet arrangement according to claim 7, wherein each of said reinforcing members is an elongated plastic bar having a cylindrical opening extending lengthwise therethrough and having a cylindrical metal tube positioned within said opening.

11. A modular pallet arrangement according to claim 7, wherein each of said reinforcing members is a rectilinear plastic bar.

12. A modular pallet arrangement according to claim 7, wherein each of said reinforcing members is a cylindrical metal tube.

13. A modular pallet arrangement according to claim 7, wherein said pallet upper section comprises four upper units and the lower section comprises three lower units.

14. A modular pallet arrangement formed of a plurality of molded plastic units adapted to be interconnected in interlocking relation to form one complete pallet that, when heavily loaded and stacked with similar pallets, is capable of being supported only by laterally spaced warehouse rack rails, comprising:

(a) an upper section including a plurality of generally similar upper units, each comprising a rectangular, grid-like, base member having, at each corner thereof, separate, integral, downwardly extending, upper connector elements;

(b) a lower section including a plurality of elongated lower units each comprising a flat, rectangular, grid-like base member having, at each end thereof and intermediate the ends thereof, multiple compartmented, integral, upwardly extending, end and center connector elements, respectively;

(c) certain compartments of certain of said lower unit connector elements being arranged and disposed for telescoping relation with corresponding upper connector elements of at least two adjacent, but separate, upper units to connect said adjacent upper units to each other, whereby said upper pallet section is supported on and by said lower pallet section.

15. A modular pallet arrangement according to claim 14, wherein said lower section includes elongated, rigid, reinforcing members extending laterally between corresponding connector elements of lower units to prevent said pallet from sagging in the center.

16. A modular pallet arrangement according to claim 15, wherein each of said reinforcing members is a solid plastic bar.

17. A modular pallet arrangement according to claim 15, wherein each of said reinforcing members is a bar having a cylindrical opening extending lengthwise therethrough.

18. A modular pallet arrangement according to claim 15, wherein each of said reinforcing members is an elongated plastic bar having a cylindrical opening extending lengthwise therethrough and having a cylindrical metal tube positioned within said opening.

19. A modular pallet arrangement according to claim 15, wherein each of said reinforcing members is a cylindrical metal tube.

20. A modular pallet arrangement according to claim 14, wherein said pallet upper section comprises four upper units and the lower section comprises three lower units.

* * * * *